US010526860B2

(12) United States Patent
Rose

(10) Patent No.: US 10,526,860 B2
(45) **Date of Patent: *Jan. 7, 2020**

(54) CASING HANGER ASSEMBLY

(71) Applicant: James A. Rose, Murrsyville, PA (US)

(72) Inventor: James A. Rose, Murrsyville, PA (US)

( * ) Notice: Subject to any disclaimer, the term of this patent is extended or adjusted under 35 U.S.C. 154(b) by 22 days.

This patent is subject to a terminal disclaimer.

(21) Appl. No.: 14/612,007

(22) Filed: Feb. 2, 2015

(65) Prior Publication Data

US 2016/0222747 A1 Aug. 4, 2016

(51) Int. Cl.

| | |
|---|---|
| ***E21B 17/00*** | (2006.01) |
| ***E21B 17/042*** | (2006.01) |
| ***E21B 33/04*** | (2006.01) |
| ***E21B 43/10*** | (2006.01) |
| ***E21B 17/046*** | (2006.01) |
| ***E21B 19/02*** | (2006.01) |

(52) U.S. Cl.

CPC ..... *E21B 33/04* (2013.01); *E21B 17/046* (2013.01); *E21B 19/02* (2013.01); *E21B 43/10* (2013.01)

(58) Field of Classification Search

CPC ..... E21B 17/046; E21B 19/02; E21B 43/10
See application file for complete search history.

(56) References Cited

U.S. PATENT DOCUMENTS

| | | | | |
|---|---|---|---|---|
| 4,641,708 | A * | 2/1987 | Wightman | E21B 43/10 166/208 |
| 4,911,244 | A * | 3/1990 | Hynes | E21B 33/043 166/123 |
| 6,015,009 | A * | 1/2000 | Allen | E21B 33/0422 166/88.2 |
| 7,900,706 | B2 | 3/2011 | Ford | |
| 7,987,904 | B1 * | 8/2011 | Rose | E21B 33/03 166/381 |
| 8,789,621 | B2 | 7/2014 | Ganzinotti, II et al. | |
| 2013/0092397 | A1 * | 4/2013 | He | E21B 33/13 166/382 |
| 2015/0300110 | A1 * | 10/2015 | Skinner | E21B 33/085 166/379 |

* cited by examiner

*Primary Examiner* — Taras P Bemko
*Assistant Examiner* — Brandon M Duck
(74) *Attorney, Agent, or Firm* — David G. Oberdick

(57) ABSTRACT

A casing hanger assembly includes a landing ring secured to a containment well cellar or the conductor pipe. A casing hanger welded to the external surface of the last section of surface casing seats into the landing ring. Optionally, a lock down mechanism can be used to prevent buoyancy and hydraulic forces from causing the well to pack off.

4 Claims, 6 Drawing Sheets

CASING HANGER ASSEMBLY

BACKGROUND AND SUMMARY OF THE INVENTION

The present invention is directed to a casing hanger assembly for use with containment well cellars of the types described and claimed in U.S. Pat. Nos. 7,637,692, 7,987,904, 8,127,837, 8,256,505, and 8,485,250 each of which is hereby incorporated by reference.

The containment well cellars described and claimed in the above noted patents are becoming increasingly recognized for their environmentally-friendly features, as well as for their advantages in well installation and operation. It is among the objects of the present invention to provide accessorial equipment which will further enhance the advantages of this family of sealed well cellars. It will be understood that the features of this invention may be equally of value when employed with other existing and as-yet-to-be-developed well cellars, or simply to hang casing in application where a well cellar is not being used.

Currently in the industry, casing hangers, both the mandrel and slip types, are used to suspend the weight of a second inner casing on first outer well casing. This may be done before or after the inner well casing is cemented in place. Existing casing hangers are a part of the wellhead assembly. Typically, when weight in the form of the blow-out-preventer (BOP) or wellhead assembly is attached to the inner casing and, thereby, supported by the partially cured cement, this weight, in conjunction with vibrations associated with the drilling operations, will cause shifting of the well casings and cracking of the cement. This breaks containment allowing migration of well fluids into the area around the wellhead, which contaminates the soil and can pollute the riparian ground water.

Unlike existing hanger systems, the casing hanger of the present invention is not part of the well-head assembly. Further, the casing hanger of the present invention may be attached to the floor of one of the well cellars described in the above noted patents distributing the weight of the well casings, any attached equipment, and associated drilling forces, over the area of the floor. This inhibits settling of the inner and outer well casings and ensures the cement remains intact for the life of the well so that migration of well gases leading to contamination of the ground water and soil surrounding the well-head is avoided.

A first aspect of the present invention comprises a well completion system including a) a sealed well cellar embedded in a region surrounding a well site, the sealed well cellar collecting well fluids and preventing the fluids from polluting the region surrounding the well site; b) a surface casing hanger secured to a floor portion of the sealed well cellar, the floor portion having a first area, the casing hanger distributing a weight supported by the casing hanger over said first area; c) a surface casing extending through the surface casing hanger and being secured thereto. In one embodiment, the surface casing hanger is welded to an external portion of the surface casing. Alternatively, the surface casing hanger is threaded onto an upper threaded portion of said surface casing. Preferably, the surface casing hanger is secured to a landing ring which is secured to an upper portion of a conductor pipe through which the surface casing extends. The landing ring may additionally include lock down means to which the hanger is secured preventing the surface casing from being pushed upwardly by buoyancy or hydraulic forces.

In a further aspect of the present invention, a well completion system comprises: a) a landing ring secured to an upper region of a conductor pipe, as by welding; b) a surface casing hanger which engages and is supported by the landing ring; c) a surface casing attached to and supported by the surface casing hanger. The well completion system may further include a sealed well cellar having a floor portion and upwardly extending walls, the floor portion of the sealed well cellar being attached to and supporting a weight of the surface casing hanger as well as a weight of the surface casing which is attached thereto. In one embodiment, the surface casing hanger is welded to an external portion of said surface casing. Alternatively, the surface casing hanger may be threaded onto an upper threaded portion of the surface casing. The landing ring may be equipped with a quick-connect fitting to receive a riser.

A third aspect of the present invention is directed to a method of completing a well comprising the steps of a) installing a conductor pipe; b) install a well cellar having a structural, load-bearing floor portion surrounding the conductor pipe; c) securing the well cellar to the conductor pipe; d) installing a landing ring by securing the landing ring to one of i) the conductor pipe and, ii) the cellar floor. The method may include the additional step of attaching a riser to an upper end of the landing ring using a quick connect profile which readily receives the riser and secures the riser thereto. The method may additionally comprise the steps of i) drilling a surface hole through the riser and ii) installing a surface casing with a surface casing hanger secured to an uppermost section of pipe by landing the surface casing hanger on the landing ring. The invention includes the further step of cementing the surface casing in place by pumping cement through the surface casing with adequate pressure to force the cement down through the surface casing and upwardly around an external surface portion of the surface casing. Finally, the steps of i) draining said riser; ii) removing said riser; and, iii) securing a well-head to the surface casing are performed.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
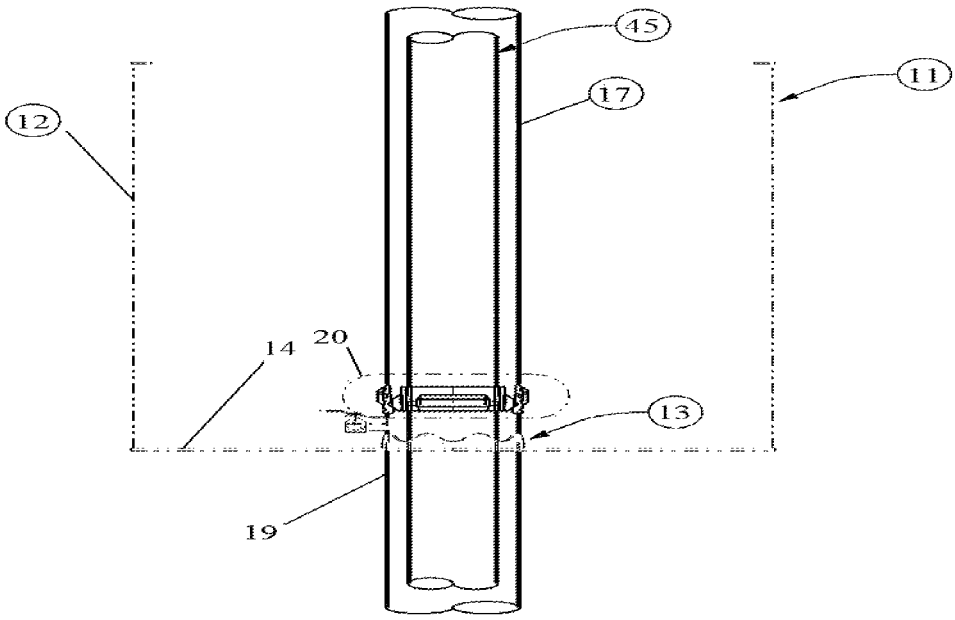
FIG. 1 is a front schematic of a first embodiment of the casing hanger of the present invention.

A first embodiment of the casing hanger assembly of the present invention is depicted in FIGS. 1-3C generally at 20. The environment in which casing hanger assembly 20 is most preferably utilized is depicted in FIG. 1 and includes a sealed containment well cellar 11 of the types disclosed in U.S. Pat. Nos. 7,637,692, 7,987,904, 8,127,837, 8,256,505, and 8,485,250. While any of these containment cellars may be used, the specific type depicted in FIG. 1 is the cellar featuring a riser with a scalloped upper edge 13 described and claimed in U.S. Pat. No. 8,485,250. Containment well cellar 11 has a horizontal floor 14 and a vertically extending wall 12 sealingly attached thereto, as by welding, for example. FIG. 1 depicts inner casing 45 being installed through detachable upper riser 17. It will be understood, however, that the casing hanger assembly 20 of the present invention may be utilized in applications which do not utilize a well cellar, such as when a separate base plate is used or the conductor provides sufficient support for the casing 45 without the need for a well cellar.

Figure 2A:
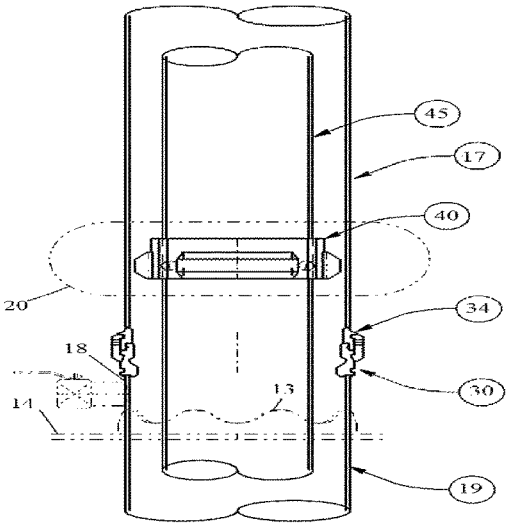
FIG. 2A is an enlarged schematic view of the casing hanger shown in FIG. 1 as the inner casing is being installed.
Figure 2B:
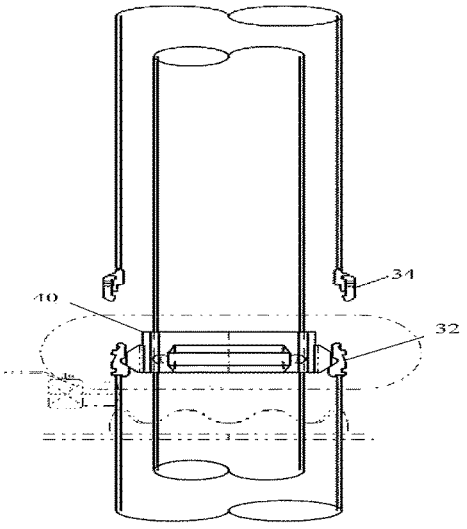
FIG. 2B is a view similar to FIG. 2A showing the inner casing fully seated and the riser released.
Figure 2C:
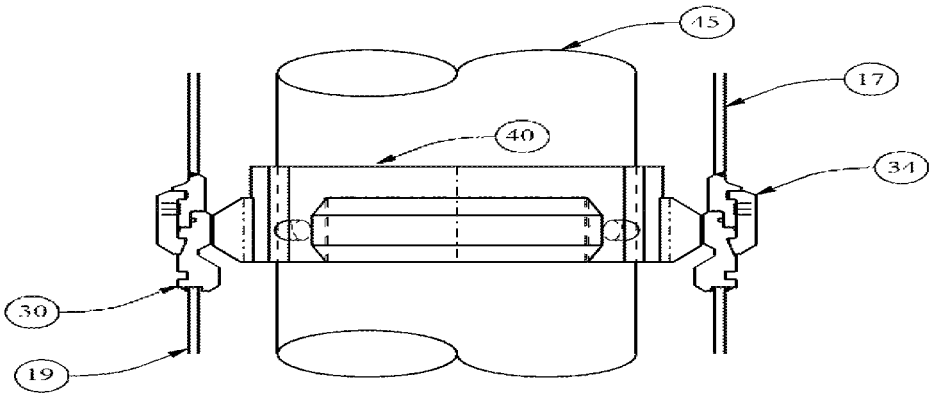
FIG. 2C is an enlarged detailed view showing the inner casing approaching the FIG. 2B position.
Figure 2D:
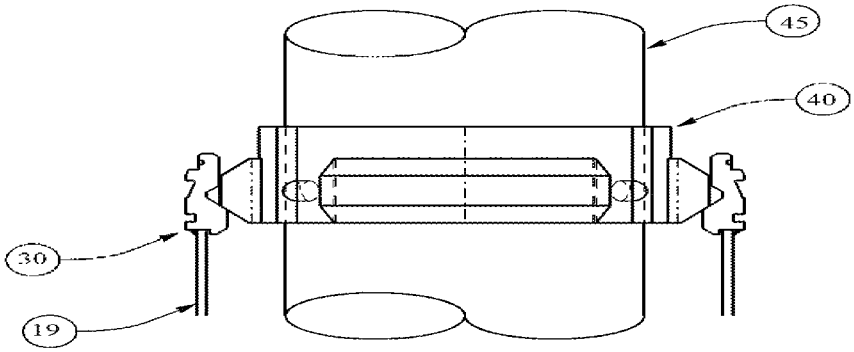
FIG. 2D is an enlarged detailed view showing the inner casing in the fully seated FIG. 2B position.

The casing hanger assembly 20 of the present invention is depicted in greater detail in FIGS. 2A-D. Casing hanger assembly 20 includes landing ring 30 and hanger 40. Landing ring 30 is secured as by welding to either the floor 14 of well cellar 11 or to the outside of the conductor pipe 19, which is, in turn, welded to the floor 14. As seen in FIG. 2A-2E, landing ring 30 is welded to the upper end 18 of conductor pipe 19. In this embodiment, landing ring 30 includes a quick connect feature 32 permitting upper riser 17 to be easily engaged and disengaged therefrom (FIGS. 2A, 2B). Riser 17 has element 34 welded to a lower end thereof which mates with quick connect feature 32.

Surface casing 45 has casing hanger 40 welded to an external surface thereof. The casing hanger will typically be welded to the last (upper) section of surface casing 45. Both securement of landing ring 30 to cellar floor 14 or conductor pipe 19 and of hanger 40 to the upper section of surface casing 45, can be performed in the shop before transporting to the field for installation, although, more typically, this step will be performed in the field. Welding in the shop may ensure a better quality weld in a more controlled environment. As depicted in FIGS. 2A-2D, surface casing 45 with casing hanger 40 welded thereto is inserted through detachable upper riser 17 until hanger 40 moves from the position shown in FIG. 2C to that depicted in FIG. 2D, fully seated and engaged in landing ring 30.

Figure 3A:
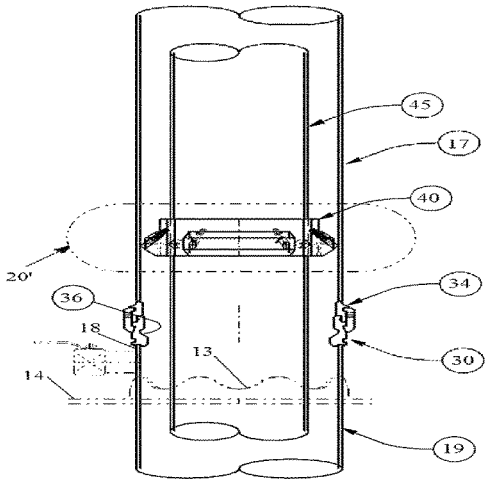
FIG. 3A is an enlarged schematic view of the casing hanger as the inner casing is being installed.
Figure 3B:
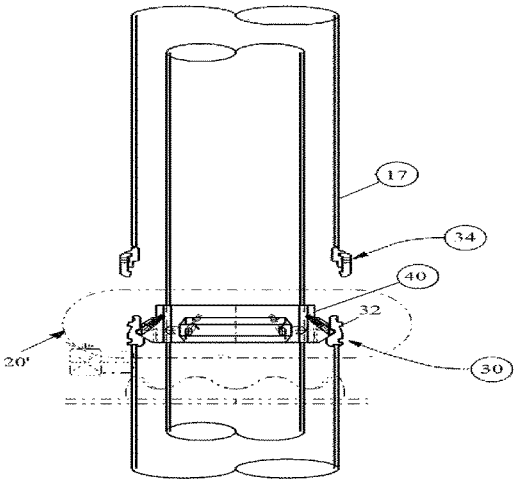
FIG. 3B is a view similar to FIG. 3A showing the inner casing fully seated and the riser released.
Figure 3C:
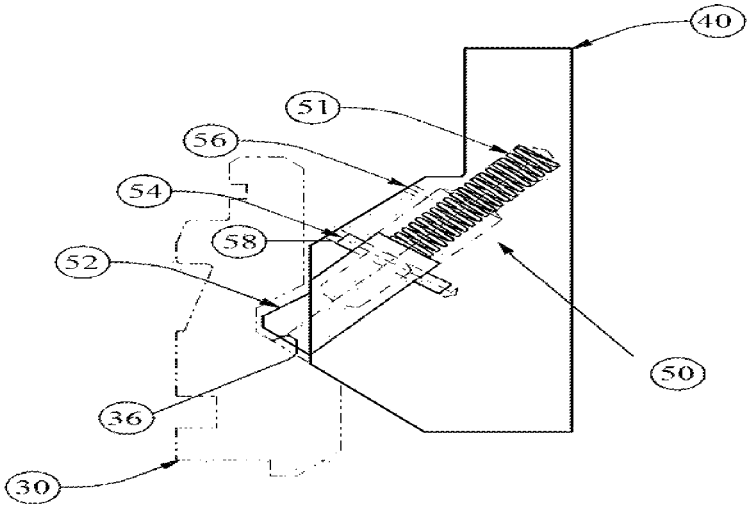
FIG. 3C is an enlarged detail of the locking mechanism used with this embodiment shown in ellipse 20' of FIG. 3B.

Preferred embodiment of casing hanger assembly 20' shown in FIGS. 3A-3C is equipped with a lock down feature 50. All remaining features of this second embodiment are the same as those of the first. Spring 51 biases lock down stud 52 into recess 36 in landing ring 30. Lock down feature 50 prevents the dangerous upward movement of surface casing 45 due to hydraulic and/or buoyancy forces within the well. Without the lock down feature 50, surface casing 45 can be forced upwardly out of engagement with the landing ring 30.

In performing the method of installation, the conductor pipe 19 is installed in a conventional manner by sliding into a drilled hole or being driven into the ground to create the well hole. If a containment cellar is to be used, then containment well cellar 11 is installed as described in the manner taught in the above cited earlier patents, which may vary depending on the type of cellar utilized. Cellar 11 is fastened/welded to conductor pipe 19. Landing ring 30 is secured, as be welding, to either the floor 14 of cellar 11 or to conductor pipe 19. In a cellarless installation, the landing ring 30 will be welded, or otherwise secured, to the conductor pipe 19. The drilling rig (not shown) may be assembled and positioned in a conventional manner.

Figure 2E:
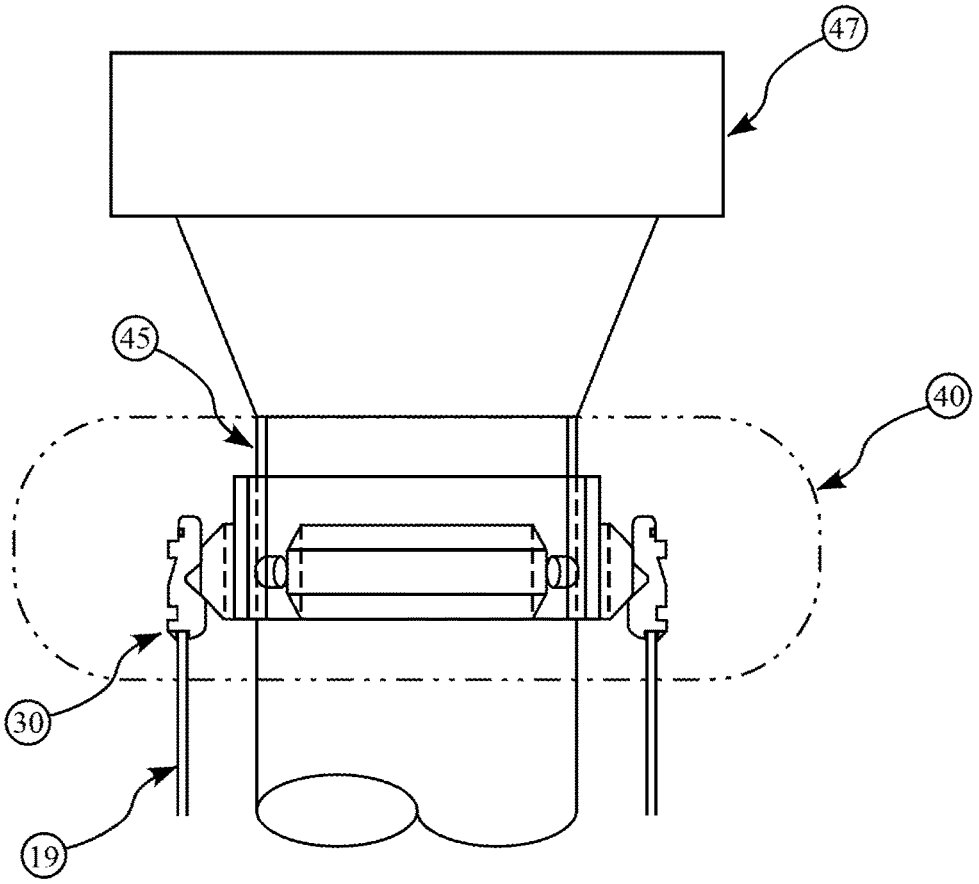
FIG. 2E is a view similar to FIG. 2D showing a wellhead assembly positioned on the inner casing after it is fully seated.

Then, the riser 17 with element 34 is secured to quick connect feature 32 on landing ring 30. The drilling rig is utilized to drill the surface hole with the surface casing 45 being run into the hole after drilling. The last joint of surface casing 45 with casing hanger 40 secured thereto is run into the hole and hanger 40 seated on landing ring 30. Cement is pumped down the interior of the surface casing 45 with adequate pressure to force the cement emerging from the end of casing 45 to migrate upwardly around the exterior of the casing 45, cementing it in place. The riser 17 is drained and element 34 unlatched/detached from quick connect feature 32. The wellhead and BOP, etc., is secured, as shown in FIG. 2E, and normal well activities are initiated. When the quick connect/disconnect feature 32 is not utilized, landing ring 30 can be welded to conductor 19 and riser 17.

The well construction system solves a significant problem with existing wells. A survey of over 100 wells in Pennsylvania and West Virginia found that over 9% of wells had gas migration problems. It was presumed that this resulted from shifting occurring while the cement was not fully set, due in part to the weight of the surface well casing and in part to the weight of the wellhead, BOP, etc. being suspended prior to the cement fully curing. Additionally, vibration associated with drilling activities exacerbates cement bonding damage. The use of the casing hanger assembly 20 permitted the distribution of this weight over the area of the load-bearing floor portion such that no shifting of the surface casing occurred after the cementing step. In the 30+ well installations employing the casing hanger assembly 20 of the present invention, none suffered gas migration. This eliminates the risk of polluting the riparian streams, aquifers, etc., and allows production to be initiated without waiting for the cement to fully cure, enhancing profitability of the well.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A well construction system comprising:

a) a conductor pipe having an upper portion and installed in a well hole;

b) a surface casing having an external surface and a weight and downward force, and extending through the conductor pipe;

c.) a surface casing hanger secured by welding to any portion of the external surface of the surface casing, whereby the surface casing hanger and the welding between the surface casing hanger and the surface casing support the weight of the surface casing, and the downward force of the weight of the surface casing is parallel to the external surface of the surface casing;

d) a base plate having a first area, the base plate being embedded in a region of the well hole and surrounding said conductor pipe and being attached thereto;

e) a landing ring secured to the upper portion of the conductor pipe and the surface casing hanger and having an internal profile for receiving the surface casing hanger to form a casing hanger assembly, whereby the surface casing hanger interacts through the landing ring and conductor pipe to distribute the weight of the surface casing over the first area of the base plate; and f) an upper riser with a lower end feature that mates with and is detachably connected to an external quick connect feature of the landing ring; and wherein the casing hanger assembly further comprises lock down assembly, the lock down assembly comprising a recess in the internal profile of the landing ring and a biased spring and stud assembly attaches to the casing hanger and, when the stud engages the recess, configured to secure the surface casing hanger and prevent the surface casing from being pushed upwardly by forces selected from a group consisting of buoyancy forces and hydraulic forces.

2. The well construction system of claim 1 wherein the base plate comprises a structural, load-bearing floor portion of a sealed well cellar, the sealed well cellar collecting well fluids and preventing the fluids from polluting the region surrounding the well site.

3. A casing hanger assembly for use with a well construction system, the well construction system having a conductor pipe with an upper region, a surface casing with a weight and downward force, an upper end and passing through the conductor pipe, and a wellhead assembly attached to the upper end of the conductor pipe, and the casing hanger assembly comprising:

a) a landing ring secured to an upper region of the conductor pipe, as by welding;

b) a surface casing hanger which engages and is supported by the landing ring; the surface casing attached by welding at any portion of the upper region of the surface casing to and supported by said surface casing hanger, whereby the surface casing hanger and the welding between the surface casing hanger and the surface casing support the weight of the surface casing, and the downward force of the weight of the surface casing is parallel to the upper region of the surface casing; and c) a lock down assembly, the lock down assembly comprising a recess in the internal profile of the landing ring and a biased spring and stud assembly attaches to the casing hanger and, when the stud engages the recess, configured to secure the surface casing hanger and prevent the surface casing from being pushed upwardly by forces selected from a group consisting of buoyancy forces and hydraulic forces.

4. The casing hanger assembly of claim 3 wherein the landing ring includes an external quick connect feature that is configured to mate with and detachably connect to a lower end feature of an upper riser.

* * * * *